340-748 SR
12/16/86 XR 4,630,039

United States Patent [19]
Shimada

[11] Patent Number: 4,630,039
[45] Date of Patent: Dec. 16, 1986

[54] DISPLAY PROCESSING APPARATUS

[75] Inventor: Yasuhei Shimada, Tokyo, Japan

[73] Assignee: Nippon Electric Co., Ltd., Tokyo, Japan

[21] Appl. No.: 420,676

[22] Filed: Sep. 21, 1982

[30] Foreign Application Priority Data

Sep. 21, 1981 [JP] Japan ..... 56-149157

[51] Int. Cl.[4] ..... G09G 1/00
[52] U.S. Cl. ..... 340/731; 340/723; 340/748
[58] Field of Search ..... 340/731, 723, 722, 724, 340/744, 748, 749, 750

[56] References Cited

U.S. PATENT DOCUMENTS 3,474,438 10/1969 Lauher ..... 340/722
3,903,517 9/1975 Hafner ..... 340/731
3,999,168 12/1976 Findley et al. ..... 340/731
4,090,188 5/1978 Suga ..... 340/731
4,107,786 8/1978 Masaki et al. ..... 340/731
4,168,489 9/1979 Ervin ..... 340/731

*Primary Examiner*—Marshall M. Curtis

[57] ABSTRACT

A display processing apparatus which can simply and easily control the size and display screen location of character patterns. The invention is comprised of a memory for storing character data of a predetermined size, an addressing circuit for reading out predetermined character data from the memory, and a transfer circuit for transferring the read character to a display circuit. The addressing circuit includes a counter, an arithmetic circuit for calculating $A=MX+B$, where X is the counter output value, M is a multiplication factor, B is a predetermined number and A is an address to be provided to the memory for reading out character data. An output shift register passes the memory output to the display circuitry only when the counter value is within predetermined limits, and a control circuit controls the values of the limits as well as M and B.

5 Claims, 8 Drawing Figures

DISPLAY PROCESSING APPARATUS

BACKGROUND OF THE INVENTION

The present invention relates to a display processing apparatus, and more particularly to a display processing apparatus including memory means in which pattern information to be displayed is stored and means for addressing the memory means to select the pattern information to be displayed.

Heretofore, a digital processor (e.g. a microprocessor, a display controller) has been used for the purpose of displaying a character pattern (such as letters, digits, symbols, marks or figures) on a display device, e.g. a CRT (cathode ray tube), LCD (liquid crystal display), and PDP (plasma display panel). Character pattern data to be displayed is preliminarily stored in a memory in the form of digital code and is read out of the memory by means of an addressing means of the digital processor. The read out character pattern data is sent to a display device, and is displayed at a designated position of a screen. Different types of signals are used in accordance with display devices for designating a position at which a character pattern is displayed. For instance, vertical and horizontal raster scanning signals are used in a CRT device, and digit and segment signals are used in an LCD device. In order to accurately display a character pattern at a designated position of a screen, these signals must be synchronized with a character pattern data to be sent to a display device. Therefore, it is preferred to simplify the coupling between the memory and the display device.

On the other hand, character pattern data is stored in a memory so as to have a predetermined pattern size. Accordingly, the size of the character pattern is always constant on a screen. Changing the size is very difficult while still keeping the aforementioned synchronous relation between the character pattern data and the signals for designating the display position. Consequently, the display processing apparatus of the prior art has the following shortcomings:

1. Since the change in size of a character pattern on a display screen is impossible, increase or decrease of a number of character patterns which can be displayed on a screen is also impossible.
2. Since intervals between vertically or horizontally consecutive characters cannot be changed, in the case whereby especially complex characters appear consecutively to each other, it is difficult to identify the respective characters.
3. In order to display a character pattern with a different size, another memory in which the character pattern data is prepared according to the different size is necessitated; and therefore, memory capacity is greatly increased.
4. It is possible to provide a circuit with a high degree of operation capability, such as function oprations between a memory and a display device, so that character data read out of the memory may be input to that circuit to carry out magnification or reduction of character size. However, this circuit is both complex and expensive. In addition, although the timing of read-out of character data and its display on a screen can be synchronized in a relatively simple manner, in the above-mentioned case the synchronization between the timing of read-out and the timing of display becomes difficult to achieve, because the operations must be effected between the memory and the display device. As a result, flickering or deviation of display is likely to occur.

SUMMARY OF THE INVENTION

It is therefore one object of the present invention to provide a display processing apparatus which has a capability of simply controlling change in size of character patterns.

Another object of the present invention is to provide a display processor which can arbitrarily set intervals between character rows.

Still another object of the present invention is to provide a display processor which has a capability of arbitrarily changing the size of characters without increasing memory capacity, and which is easily formed in an integrated circuit.

Yet another object of the present invention is to provide a display processor which can achieve magnification or reduction of characters without disturbing the synchronization between the timing of read out of character pattern data and the timing of character pattern data display.

According to one feature of the present invention, there is provided a display processing apparatus comprising a memory for storing character data of a predetermined size, an addressing circuit for reading out predetermined character data from the memory by addressing, and a transfer circuit for transferring the read character data to a display circuit, in which the addressing circuit includes a first means for successively generating consecutive address data at a predetermined timing and a second means for generating nonconsecutively varying address data.

For instance, a ring counter is available as the first means. As the second means, an arithmetic circuit for modifying the output of the ring counter may be used.

According to the present invention, instead of carrying out operation processing on character data, operation processing on address data which is used for reading character data is effected. Accordingly, provided that the timing of the read-out of character data is synchronized with the timing of display, then the modification of the address data does not disturb the synchronization. Moreover, by modifying the address data it is possible to arbitrarily change the size of characters to be displayed. For instance, if the memory circuit is accessed by mapping only even number address or only odd number addresses among the consecutive address data, then characters reduced by a factor of ½ can be displayed. On the other hand, by accessing a memory circuit while repeating every address n times (n being a positive integer), characters magnified by a factor of n can be displayed.

Furthermore, the first means and the second means could be coupled to each other so that either the consecutive address data derived from the first means may be passed in themselves through the second means and then applied to the memory or the consecutive address data may be modified in the second means and then applied to the memory. The address data can be easily modified by making use of a multiplier and an adder or a subtractor or the like according to necessity. The second means could be constructed of a combination of these arithmetic circuits. For instance, if the second means is constructed of a multiplier (X2), then among the addresses issued from the first means only the addreses at the even-numbered orders can be applied to the memory. In addition, as will be described later, according to the present invention it is also easy to arbitrarily change the intervals in the vertical and/or horizontal direction between adjacent characters. Furthermore, since the present invention is equally applicable to either a display device having an interlacing function or non-interlacing function, the usefulness of the invention is is improved.

BRIEF DESCRIPTION OF THE DRAWINGS

The above-mentioned and other objects, features and advantages of the present invention will become more apparent by reference to the following description of a preferred embodiment of the invention taken in conjunction with the accompanying drawings.

BRIEF DESCRIPTION OF THE PRIOR ART

Figure 1:
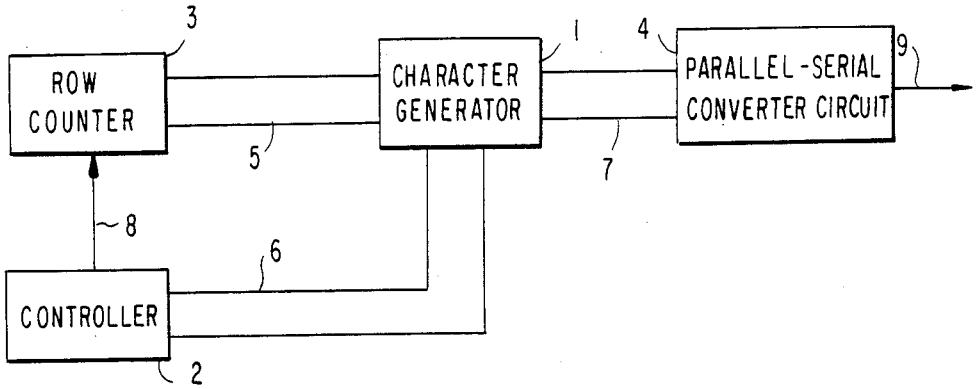
FIG. 1 is a block diagram of an essential part of a display processing apparatus in the prior art.

A display processor in the prior art will be explained in greater detail with reference to a block diagram of an essential part thereof illustrated in FIG. 1. A group of letters, digits, symbols, figures, etc. are stored in a character generator (memory) 1 in a predetermined size. A controller 2, for controlling the address, outputs a character name address 6 and a row counter set signal 8 at predetermined timing.

Now one character stored within the character generator 1, for example, a character "A" will be picked up and a dot-structure of the character "A" will be described with reference to FIG. 2. The character "A" is encoded within a dot matrix 10 of a predetermined size (for instance, 14 rows×7 columns). Each dot D forming the matrix consists of a transistor element, a diode element, a fuse element or the like. In general, setting of "0" or "1" serving as character data is effected by breakdown or non-breakdown of a junction or ON/-OFF of a fuse element. Now it is assumed that in the dot matrix shown in FIG. 2, in the dot represented by a blanked square is stored a datum "0", and in the dot represented by a hatched square is stored a datum "1". When a character name address 6 designating the character "A" is output from the controller 2 in FIG. 2, it is decoded by a column decoder 11 so that selection signals 0–6 may be generated simultaneously in parallel to select the matrix 10. As a result, the character "A" is selected, and reading of the character is executed by a row address applied from a row counter 3. The row counter 3 has a function of sequentially outputting the respective values 0–13, each of the output values is decoded by a row decoder 12 to sequentially generate row selection signals $l_0, l_1, \ldots, l_{13}$. The timing of outputting the respective for selection signals $l_0, l_1, \ldots, l_{13}$ is synchronized with the horizontal scanning cycle of a CRT display screen. 7-dot data read out for every row are transferred in parallel to an output circuit 13, and then transferred to a parallel-serial converter 4 through a bus 7. After the 7-dot parallel data have been converted into serial data, they are sequencially transferred to a CRT display device.

As will be seen from the above explanation, the size (meaning a number of dots) of the character that can be displayed on the CRT is coincident to the size (meaning a number of dots) of the character set within the character generator (that is, in the illustrated example 7×14). Accordingly, the number of character rows that can be displayed on the CRT display screen was necessarily fixed, and change of the number of character rows is difficult. Moreover, in such a display processor in the prior art, magnification or reduction in size of characters is also difficult. Furthermore, intervals in the vertical or horizontal direction between adjacent characters are predetermined, so that change of the intervals is difficult, too.

In this connection, although a display processor having a capability of displaying characters in a magnified or reduced size has been proposed in the prior art, the display processor necessitated to additionally provide a memory (character generator) for magnified display or for reduced display, hence increase of the memory capacity was immeasurable and the display processor had an extremely high cost. Further, if an arithmetic circuit is inserted between the character generator 1 and the converter 4 to change a character size, it becomes very hard to synchronize with a character pattern data and a display timing signal.

DETAILED DESCRIPTION OF EMBODIMENTS

Figure 2:
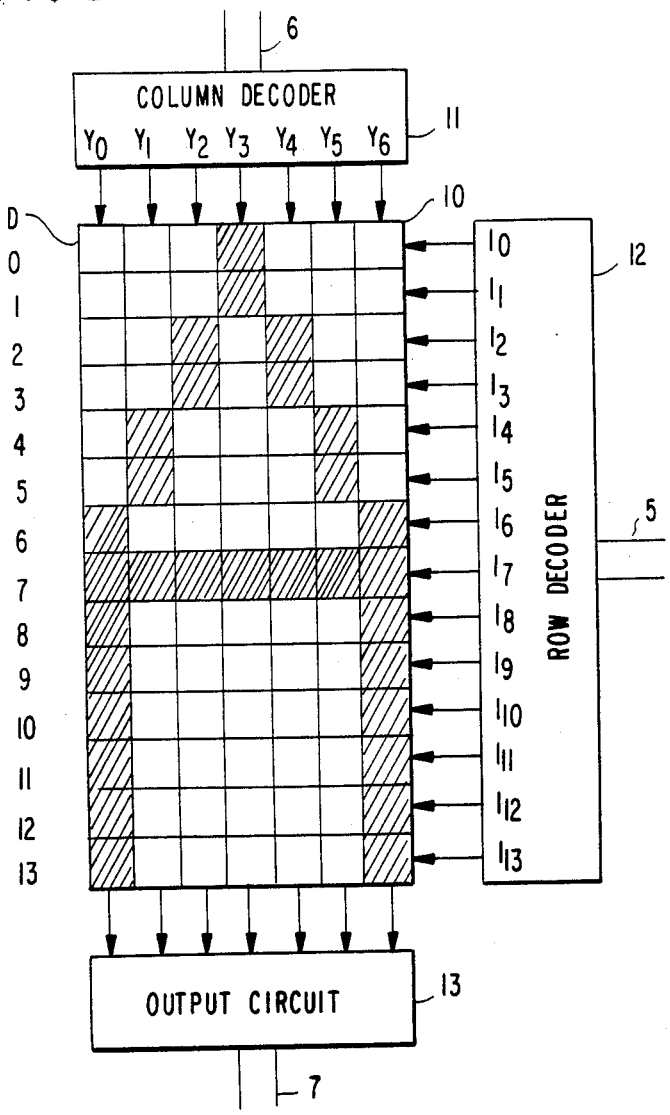
FIG. 2 is a block diagram showing a dot-construction of one characters within a memory and connecting relations between the memory and an address decoder and an output circuit.
Figure 3:
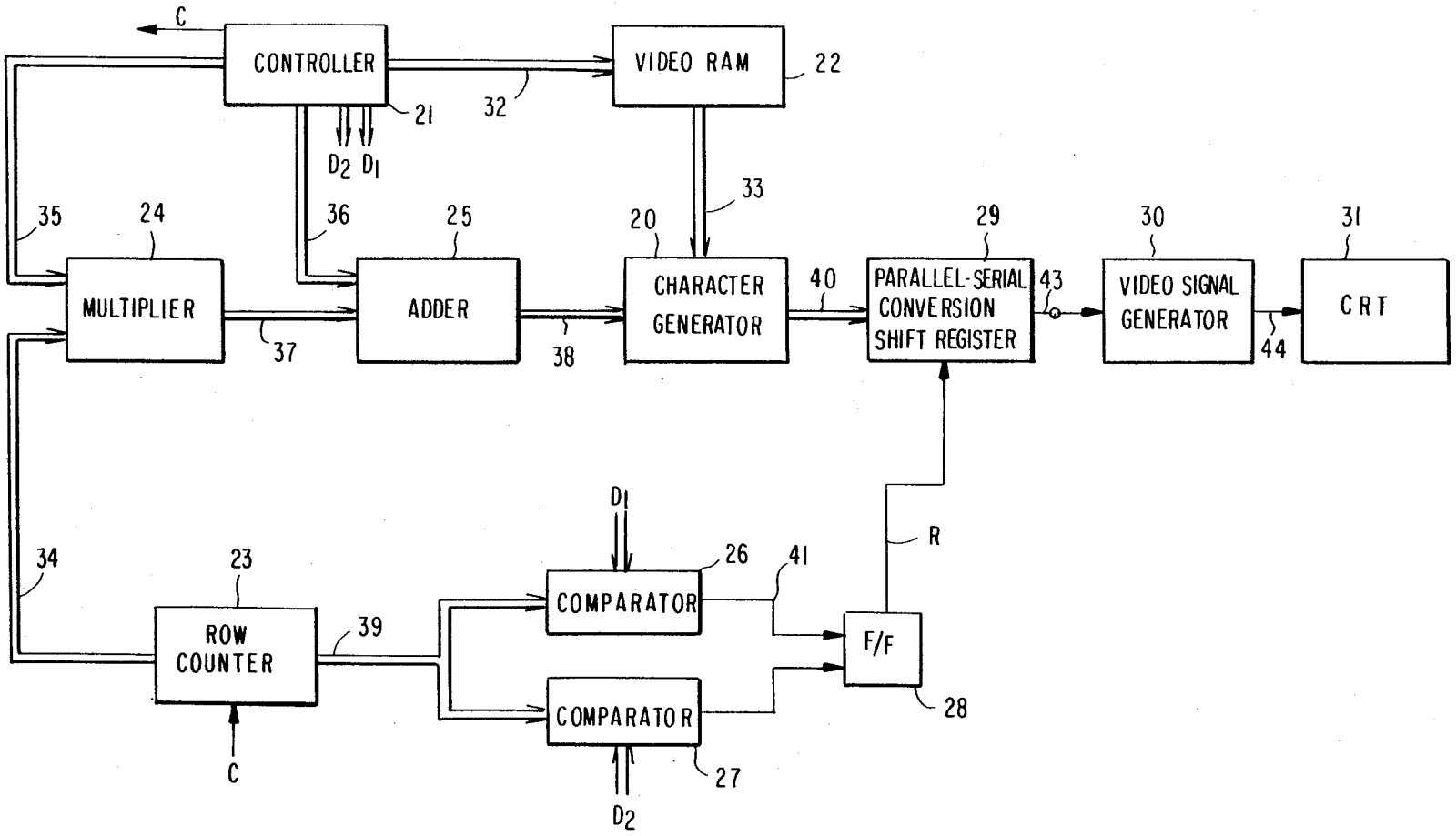
FIG. 3 is a block diagram showing a display processing apparatus according to one preferred embodiment of the present invention.

FIG. 3 is a block diagram showing one preferred embodiment of the present invention. A character generator 20 is essentially a memory in which a group of letters, digits, symbols, figures, etc. are stored in the dot constructions as shown in FIG. 2. Each character name address is generated from a video RAM 22 and is input to the character generator 20 (in practice, to the column decoder shown in FIG. 2) through a bus 33. In the case where a CRT 31, for example, is used as a display device, in the video RAM 22 the character name addresses of all the characters to be displayed on one display screen of the CRT are edited along the scanning direction of horizontal scanning lines for one picture area. This edit is achieved by a controller 21 consisting of, for example, a microprocessor, and the edited character name addresses are written via a bus 32 into the video RAM 22 prior to the display. Furthermore, an output of a row counter 23 that is reset to its initial state by a control signal C fed from the controller 21, is subjected to operations as will be described later in a multiplier 24 and an adder 25, and the result of operations is applied via a bus 38 to the character generator 20 as a row selection address. In practice, the result is input to the row decoder shown in FIG. 2.

In this case, from the video RAM 22 are sequentially output the character name addresses as there are characters that can be displayed in one row on the display screen of the CRT 31, in their display sequence for each horizontal scanning cycle. On the other hand, in each horizontal scanning cycle, the row selection address for the character generator 20, that is, the count data in the row counter 23, are not varied. The row selection address of the row counter 23 is varied each time one horizontal scanning cycle has been completed.

Figure 4:
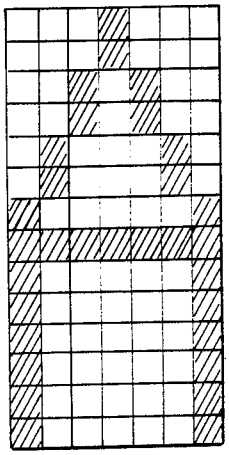
FIGS. 4 to 8 are illustrations of different display patterns for same one character processed in different manners by the display processor shown in FIG. 3.

Now it is assumed that each character stored within the character generator 20 is constructed of a dot matrix of 14 rows×7 columns as shown in FIG. 2. In the case of displaying a character "A" as illustrated in FIG. 2, an address designating the character "A" is output from the video RAM 22. At this moment, the count data in the counter 23 is "0". The controller 21 sets a multiplier factor "1" in the multiplier 24 via a bus 35 and an added factor "0" in the adder 25 via a bus 36. Accordingly, each row selection address output from the row counter 23 is applied unchanged to the character generator 20. As a result, a character of the same size as the character "A" set in the character generator 20 is displayed on a screen through a scanning of 14 horizontal scanning lines as shown in FIG. 4.

Figure 5:
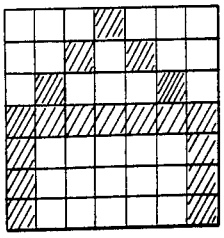

On the other hand, if it is desired to reduce the size of the characters to be displayed by a factor of ½ in the vertical direction, then a multiplier factor "X2" and an added factor "+1" are set in the multiplier 24 and the adder 25, respectively. Consequently, in response to a series of output counts "0, 1, 2, 3, . . . " from the row counter 23, a series of odd numbers "1, 3, 5, 7, . . . " are output from the adder 25. Accordingly, only the coded data in the odd-numbered rows are selected and are displayed as shown in FIG. 5. Here, it will be seen that the size of the displayed character has been reduced by a factor of ½ in the vertical direction. It is to be noted that in the case of the above-mentioned reduced display, the row counter 23 is controlled by the controller 21 in such a manner that when the count in the counter 23 has become "6", it may be detected by the controller 21 and in response thereto the counter 23 may be reset to "0", so that the count value in the counter 23 may change only within the range of "0" to "6".

In this way, the size of the character to be displayed can be changed in a simple manner by modifying the output of the row counter 23 with the multiplier 24 and/or the adder 25. It is to be noted that the character code data read out of the character generator 20 are converted into serial data 43 by means of a parallel-serial conversion shift register 29 and then output therefrom. The output data are input to a video signal generator 30, and an output video signal 44 is applied from the video signal generator 30 to the CRT 31.

Furthermore, display positions of characters can be arbitrarily changed by adding comparators 26 and 27 in FIG. 3 as will be explained in the following. In the illustrated embodiment, the comparator 26 includes a circuit for generating a start position signal 41 which indicates a display start position (a display start scanning line). Likewise, the comparator 27 includes a circuit for generating an end position signal 42 which indicates a display end position (a display end scanning line). Data for comparison applied to the comparators 26 and 27 are sent from the controller 21 as data $D_1$ and data $D_2$, respectively. These data for comparison $D_1$ and $D_2$ are compared at any arbitrary time with the count in the row counter 23, and if the count in the counter 23 coincides with the data $D_1$, then a signal 41 for setting a flip-flop 28 is generated. On the other hand, if the count in the counter 23 coincides with the data $D_2$, then a signal 42 for resetting the flip-flop 28 is generated. The parallel-serial conversion shift register 29 is controlled in such a manner that it may be set when the flip-flop 28 has been set in the above-described fashion and it may be reset when the flip-flop 28 has been reset by the signal 42. When the shift register 29 is set, data read out of the character generator 20 are allowed to be input to the shift register 29, whereas when it is reset, the data is inhibited from being input to the shift register 29.

Figure 6:
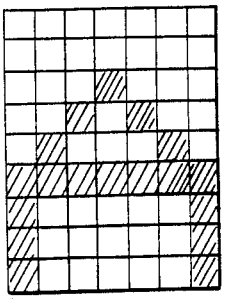

It is assumed, by way of example, that the controller 21 has set "2" in the comparator 26 as the data $D_1$, and on the other hand it has set "9" in the comparator 27 as the data $D_2$. Under such condition, when the count in the row counter 23 has become "2", the shift register 29 is activated for the first time, and when the count in the counter 23 has become "9", the shift register 29 is reset, that is, inactivated. It is assumed that during this operation the addend in the adder 25 is set at "−3". In such a case, a subtractor could be employed instead of the adder. If the count operation of the row counter 23 is commenced under the above-mentioned condition, then character data are not output from the character generator 20 during the period when the count in the row counter 23 is "0" or "1×, and hence the CRT 31 is in a non-display condition. Subsequently, when the count in the row counter 23 has become "2", the flip-flop 28 is set, and so, the shift register 29 is set in a ready-to-receive condition for the input data. At that time, if a multiplier factor "X2" has been already set in the multiplier 24, then the resultant row selection address becomes $(2\times2-3)=1$, and hence data stored in the row $l_1$ in FIG. 2 are output from the character generator 20. As a result, on the CRT 31, the data corresponding to the row $l_1$ of the character "A" is displayed for the first time on the third horizontal scanning line. Subsequently, each time the count in the row counter 23 is changed in the sequence of 3, 4, 5, 6, 7 and 8, the row selection address applied to the character generator 20 is changed in the sequence of 3, 5, 7, 9, 11 and 13, and therefore, the same pattern as that shown in FIG. 5 is displayed on the CRT 31. Further, when the count in the row counter 23 has become "9", the flip-flop 28 is reset by the output of the comparator 27, so that the parallel-serial conversion shift register 29 does not receive the subsequent input data. Accordingly, as shown in FIG. 6, two scanning lines above the character "A" form a non-display region, and in this way an interval between vertically adjacent characters can be provided.

It is to be noted that a similar interval equal to a width of two horizontal scanning lines can be provided under the character "A" by setting "0" and "7" in the comparators 26 and 27, respectively, and setting a multiplier factor "X2" in the multiplier 24 and an addend "+1" in the adder 25.

Figure 8:
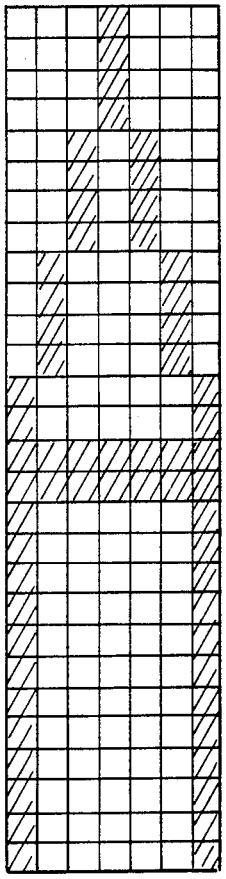

Further, when a multiplier factor "X½" and an added factor "+0" are set in the multiplier 24 and the adder 25, respectively, a character as shown in FIG. 8 is displayed. In this case, the row counter 23 must be able to count 0 to 27, and only integer outputs must be sent from the multiplier 24 to the adder 25. That is, for the counts 0 to 27 of the row counter 23, the result of multiplication are 0, 0.5, 1, 1.5, 2, 2.5, 3 . . . 13, 13.5. Accordingly, 0, 0, 1, 1, 2, 2, 3 . . . 13, 13 are input to the adder 25. This means that the same address is repeated two times and is applied to the character generator 20. Therefore, the size of the character pattern displayed on a screen is doubled, as shown in FIG. 8. A divider may be employed instead of the multiplier 24. Of course, the adder 25 may be omitted.

According to the present invention, the size of character pattern data to be displayed can be easily changed without modifying the read-out character pattern data, so that the character pattern data transferred to the CRT 31 can be easily synchronized with a scanning signal of the CRT 31. In the prior art, however, if 80 characters were to be displayed in one horizontal scanning period, each of the 80 characters would have to be changed in order to magnify or reduce the display. In comparison, the present invention can easily and accurately change the size of a character pattern by merely modifying the row address.

Figure 7:
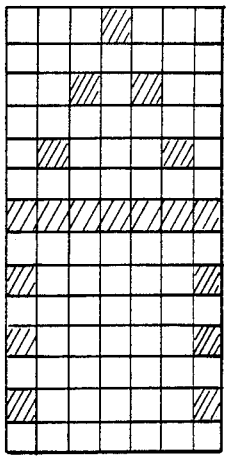

Obviously, the above-described control can be achieved regardless of whether the scanning system of the CRT 31 is an interlace system or not. For a CRT of the scanning type not employing the interlace system, since a pattern is displayed only on alternate horizontal scanning lines, if the maximum value of the row counter is set at "13", the multiplier factor in the multiplier 24 is set at "X2" and the addend in the adder 25 is set at "+0", it is possible to read out only the data stored in the odd-numbered rows ($l_1$, $l_3$ . . . $l_{13}$) of the character generator in FIG. 2 and display them only on the even-numbered horizontal scanning lines in the displayed character pattern, as shown in FIG. 7.

Furthermore, with respect to the character "A" displayed on the display screen, if the value of the comparison data $D_2$ set in the comparator 27 is decreased by one from its maximum value each successive frame cycle after the character "A" has been once displayed, then control can be effected in such a manner that the displayed character pattern may be erased gradually from its bottom, that is, in the order of the row selection addresses 13, 12, . . . , 0, starting from the bottom row selection address 13. Such a mode of control for erasing has an advantage over instantaneous erasing of a displayed pattern in that the erasing of the pattern is more distinctly impressed in the operator's mind.

If the invention is modified, selection addresses are applied from the video RAM 22 to the character generator 20 and column selection addresses are derived from the count in the counter 23 through the multiplier 24 and the added 25 and are then applied to the character generator 20, effects and advantages similar to those of the first embodiment of this invention could be expected.

Furthermore, the constructions of the comparators 26 and 27 could be modified in such manner that the comparator 26 may detect the condition of [the count in the counter 23]$>D_1$, while the comparator 27 may detect the condition [the count in the counter 23]$<D_2$, and an AND gate could replace the flip-flop 28.

What is claimed is:

1. A display processing apparatus, comprising:

a memory for storing at least one pattern information; a display device for displaying a pattern in accordance with a display unit;

coupling means for coupling an output of said memory as said display input to said display device;

an address generator circuit for applying an address to an address input of said memory for reading the pattern information out of said memory, said address generator circuit having a controller for providing first and second predetermined values, a multiplier for multiplying an address by said first predetermined value and an adder for adding an output of said multiplier to said second predetermined value; and output of said adder being applied to said address input of said memory; and a display control circuit coupled to said coupling means for generating a first timing signal indicating a display start position and a second timing signal indicating a display end position and for controlling transmission of information read out of said memory to said display device in accordance with said first and second timing signals.

2. A display processing apparatus for displaying a character pattern on a display screen, comprising:

a memory for storing a plurality of character pattern data;

a first means coupled to said memory for selecting one of the character pattern data in said memory;

a second means for generating consecutive addresses for reading the selected character pattern data out of said memory with said selected character pattern data being divided into a plurality of data blocks with each block being sequentially read out of memory according to said consecutive addresses;

a third means for modifying each of said consecutive addresses in accordance with an arithmetic operation including multiplication and addition and for applying the modified addresses to said memory;

a fourth means coupled to said memory for transferring the sequentially read-out data blocks to a display device; and a fifth means for generating a display start signal for determining a display start position of the selected character pattern on the display screen and a display end signal for determining a display end position of the selected character pattern on the display screen, and for controlling a transmission timing of said fourth means in accordance with said display start signal and said display end signal.

3. A display processing apparatus as claimed in claim 1, wherein said address generator circuit includes a counter for generating consecutively varying addresses as its count output, said consecutively varying addresses being sequentially applied to said multiplier.

4. A display processing apparatus as claimed in claim 3, wherein said consecutively varying addresses are also supplied to said display control circuit for generating said first and second timing signals.

5. A display processing apparatus as claimed in claim 2, wherein said fifth means comprises:

first and second comparators for comparing said consecutive addresses to first and second address data, respectively;

control means for changing said first and/or second address data; and said fifth means generating said display start signal in response to an output of said first comparator and said display end signal in response to an output of said second comparator.

* * * * *